US009033711B2

(12) United States Patent
Guenther et al.

(10) Patent No.: US 9,033,711 B2
(45) Date of Patent: May 19, 2015

(54) INTERACTIVE SYSTEM AND METHOD FOR SHOOTING AND TARGET TRACKING FOR SELF-IMPROVEMENT AND TRAINING

(71) Applicants: Kenneth W Guenther, Portland, OR (US); Scott MacIntosh, Boston, MA (US); Erik Bodegom, Portland, OR (US)

(72) Inventors: Kenneth W Guenther, Portland, OR (US); Scott MacIntosh, Boston, MA (US); Erik Bodegom, Portland, OR (US)

( * ) Notice: Subject to any disclaimer, the term of this patent is extended or adjusted under 35 U.S.C. 154(b) by 0 days.

(21) Appl. No.: 14/213,871

(22) Filed: Mar. 14, 2014

(65) Prior Publication Data

US 2014/0272807 A1 Sep. 18, 2014

Related U.S. Application Data

(60) Provisional application No. 61/790,111, filed on Mar. 15, 2013.

(51) Int. Cl.
*F41G 3/26* (2006.01)
*F41A 33/00* (2006.01)

(52) U.S. Cl.
CPC ..... *F41G 3/2605* (2013.01); *F41A 33/00* (2013.01)

(58) Field of Classification Search
USPC ..... 434/19, 20, 21, 22
See application file for complete search history.

(56) References Cited

U.S. PATENT DOCUMENTS

| | | | | |
|---|---|---|---|---|
| 3,709,124 | A * | 1/1973 | Hunt | 396/426 |
| 5,233,776 | A * | 8/1993 | Hessey | 42/54 |
| 5,822,713 | A * | 10/1998 | Profeta | 701/302 |
| 5,887,375 | A * | 3/1999 | Watson | 42/106 |
| 6,070,355 | A * | 6/2000 | Day | 42/106 |
| 6,322,365 | B1 * | 11/2001 | Shechter et al. | 434/21 |
| 7,194,204 | B2 * | 3/2007 | Gordon | 396/263 |
| 7,291,014 | B2 * | 11/2007 | Chung et al. | 434/11 |
| 7,360,332 | B2 * | 4/2008 | Rozovsky | 42/70.07 |
| 7,688,219 | B2 * | 3/2010 | Hudson et al. | 340/686.1 |
| 8,022,986 | B2 * | 9/2011 | Jekel | 348/139 |
| 8,613,619 | B1 * | 12/2013 | Couet et al. | 434/11 |
| 2008/0233543 | A1 * | 9/2008 | Guissin | 434/19 |
| 2011/0207089 | A1 * | 8/2011 | Lagettie et al. | 434/22 |
| 2012/0270186 | A1 * | 10/2012 | Singh | 434/19 |

* cited by examiner

*Primary Examiner* — Robert J Utama
(74) *Attorney, Agent, or Firm* — Mark S Hubert

(57) ABSTRACT

A device configured to track and capture the movement data of a target as well as shooting and firearm movement activity of a hunter includes a housing, a camera, sensors, a processor, a memory, and a battery. The camera is disposed in close proximity to the housing to capture the movement of a target. One or more sensors are disposed in the housing and interfaced with the processor to capture the velocity and orientation of a gun. A trigger activation sensor is also in communication with the processor. The memory stores camera activity, trigger activity, sensor activities, and also stores an alarm setting on the device. The processor activates the alarm setting when predefined criteria are met. Radar can be incorporated to determine the distance of the target from the user. GPS can also be included to provide precise location and time information.

1 Claim, 7 Drawing Sheets

INTERACTIVE SYSTEM AND METHOD FOR SHOOTING AND TARGET TRACKING FOR SELF-IMPROVEMENT AND TRAINING

CROSS REFERENCE TO RELATED APPLICATION

This application claims the benefit under Title 35, United States Cod, Section 120 of U.S. patent application Ser. No. 61/790,111 filed Mar. 15, 2013 which is hereby incorporated by reference into this application.

FIELD OF THE INVENTION

The present disclosure relates to systems and methods for capturing movement activity as it specifically relates to a hunter training system for improving shooting skills.

BACKGROUND OF THE INVENTION

The hunting of waterfowl is a popular activity throughout the United States and in many parts of the world. As any hunter will tell you becoming an efficient hunter of game birds requires years of practice, and shooting stationary targets provides little help in developing the eye-hand coordination required to hit a moving target. While skeet shooting provides a better simulation, the skeet's trajectory is parabolic and predictable unlike that of bird's flight path. Additionally, skeet shooting is expensive. Combined with a short hunting season, hunters are left with few options to safely sharpen their gun skills without wasting ammunition and/or paying for time at a skeet range.

It is in this context that the embodiments described herein arise.

SUMMARY OF THE INVENTION

The present disclosure describes embodiments for systems, devices, computer readable media, and methods for capturing movement activity as it relates to hunting or simulated hunting with remote computing devices and transferring that data to remote computing devices for review and interpretation.

In one embodiment a device configured for capturing targeted images and trigger movement to improve gun-handling skills is provided. The device includes a retrofit assembly capable of being attached to any shotgun and includes a camera, a housing, an inertial measurement unit, a battery, a processor, a memory, and a trigger sensor.

In another embodiment a device configured for capturing targeted images and trigger movement is a gun-resembling apparatus having a gunstock and a barrel and includes a camera, an inertial measurement unit, a battery, a processor, a memory, and a trigger sensor.

In one embodiment the housing further includes a radar assembly to determine the range, altitude, direction and/or speed of the targeted images.

In one embodiment the housing further includes an alarm for notifying the user of a "hit."

In another embodiment the housing further includes wireless communication logic configured to pair with a remote computing device.

In yet another embodiment the device is associated with a web-based user account wherein a user can access his or her account via a website to manage and review activity captured by the device.

The tracking device and system of the present invention allows hunters to improve their gun skills using their own gun while targeting live game birds. Users can simulate shooting of game birds out of hunting season, or can track their firing of live ammunition during hunting season. Users can enter personal data via a web-based user account accessed via the Internet to increase the accuracy of the data recorded and manipulated by the tracking device. The number of shots fired, hits, misses, etc., can easily be tracked as the data collected can be wirelessly transferred and viewed on a computing device.

The present invention is capable of other embodiments and of being practiced and carried out in varying ways. Additional aspects will become apparent from the following detailed description taken in conjunction with the accompanying drawings.

DETAILED DESCRIPTION

The embodiments described herein may be practiced with various computer system configurations including retrofit devices, microprocessor systems, programmable consumer electronics, mainframe computers, and distributed network computing environments. The embodiments described herein also employ various computer-implemented operations to data stored in various computer systems and can be specifically configured to perform these operations.

Figure 1:
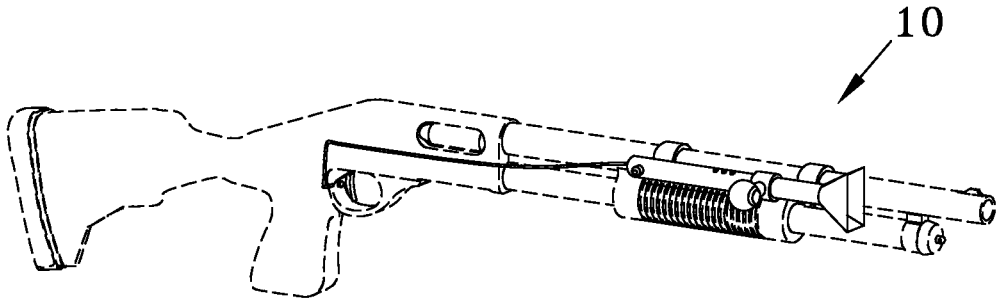
FIG. 1 is a perspective view of the tracking device of the present invention secured along the side of the barrel of a firearm.
Figure 2:
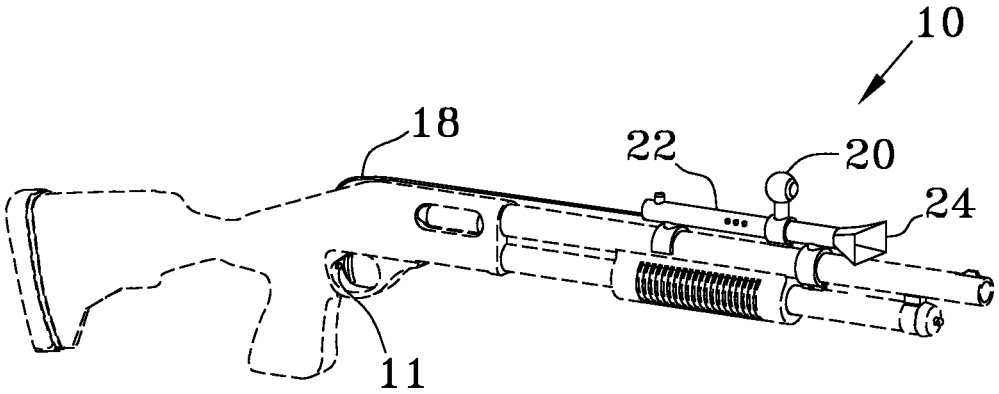
FIG. 2 is a perspective view of the tracking device of the present invention secured along the top of the barrel of a firearm.
Figure 3:
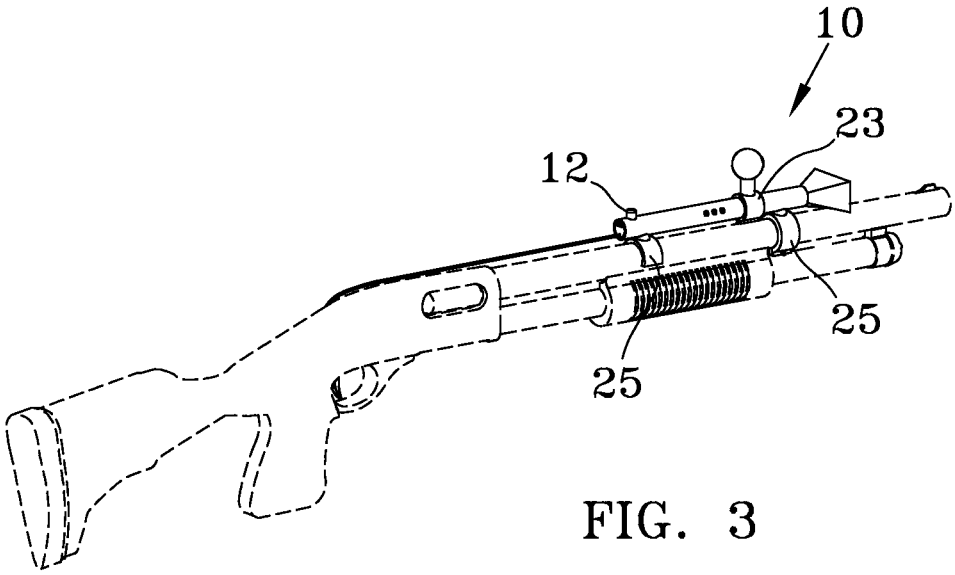
FIG. 3 is a second perspective view of the tracking device of the present invention secured along the top of the barrel of a firearm.

Turning now descriptively to the drawings, FIGS. 1-3 illustrate the tracking device 10 of the present invention. Tracking device 10 is designed to mechanically affix to the barrel of any shotgun, rifle, or firearm. As illustrated in FIG. 1 tracking device 10 is affixed along the side of a shotgun barrel, while in FIGS. 2-3, tracking device 10 is affixed along the top of a shotgun barrel. Adjustable mounting brackets 25 allow a user to position and secure tracking device 10 along a firearm's barrel at a location that best meets the user's needs.

Figure 4:
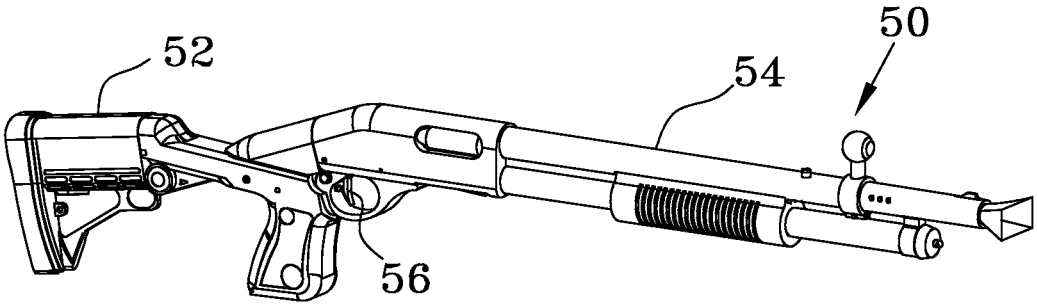
FIG. 4 is a perspective view of an alternate embodiment of the present invention
Figure 5:
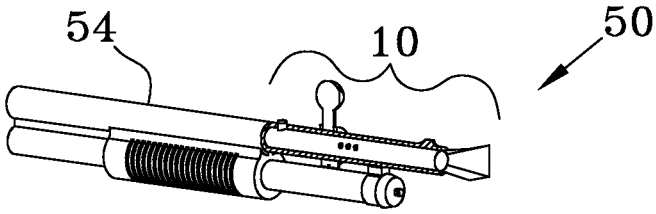
FIG. 5 is a partial cut-away of the barrel section of the alternate embodiment illustrated in FIG. 4.

In an alternate embodiment illustrated in FIGS. 4-5, tracking device 10 is incorporated into a gun-resembling apparatus 50, having a gunstock 52, barrel 54, and trigger 56. Gun-resembling apparatus 50 cannot fire ammunition and can only simulate shooting, while being used as training device for efficiently improving a user's targeting and shooting skills.

Figure 6:
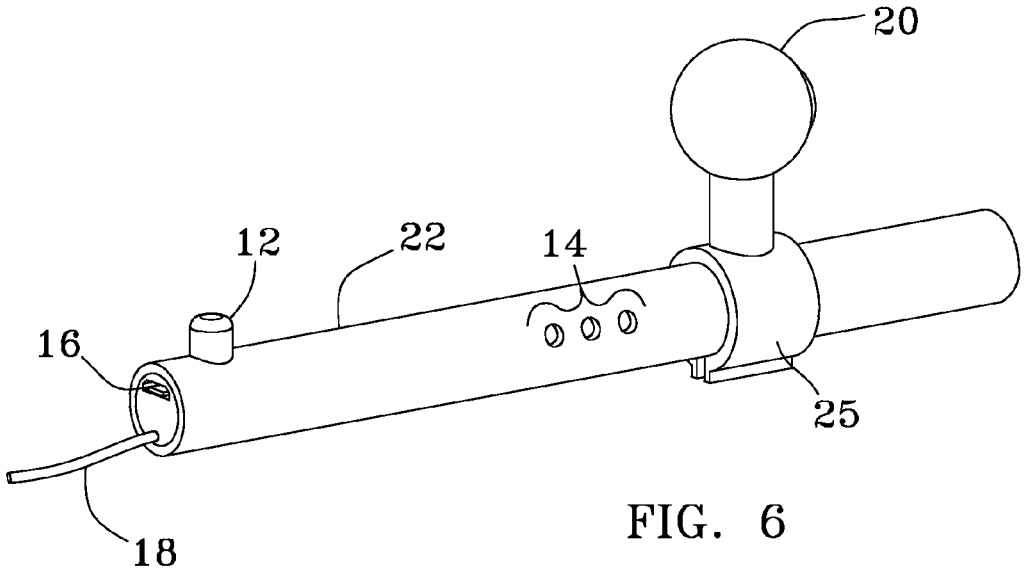
FIG. 6 is a partial perspective view of the tracking device of the present invention.
Figure 7:
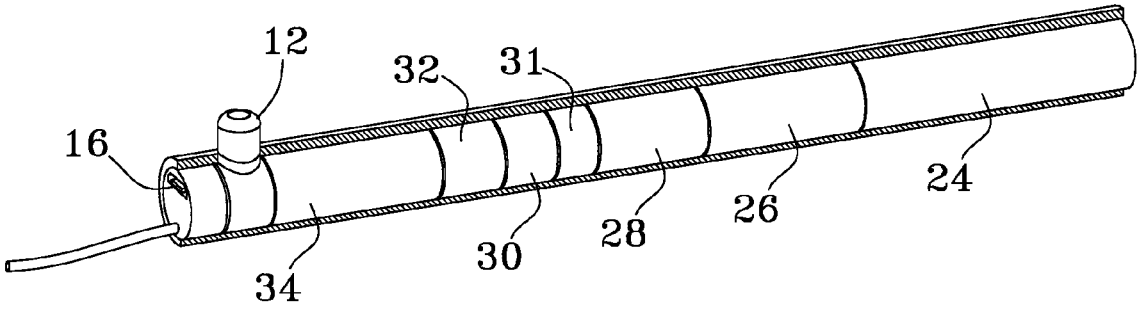
FIG. 7 is a partial perspective view of the tracking device of the present invention with a portion of the housing and the camera removed for visual clarity.

The components of tracking device 10 are visible in FIGS. 6-7. In the most basic embodiment tracking device 10 comprises camera 20, housing 22, inertial measurement unit 26, processor 30, memory 32, and battery 34. Trigger sensor 11 is connected via cable 18 to battery 34 and processor 30. In gun-resembling apparatus 50 the need for a separate trigger sensor 11 is omitted as the trigger 56 itself is connected via cable (not shown) to battery 34 and processor 30. Additionally, tracking device 10 may include radar sensor 24, and may additionally include alarm 28. It should be noted and understood that not all of the microelectronics and interfacing circuitry of tracking device 10 will be discussed and/or illustrated herein for the sake of brevity as they are outside the scope of this invention and known in the industry.

Tracking device 10 includes camera 20 which can be a digital, or infrared camera designed to capture still or video images in the sight line of a firearm's barrel at a sufficient distance from tracking device 10 to simulate a real-life hunting distance of approximately 30-50 meters—that is the camera is focused at a distance typically encountered in hunting game birds. Camera 20 can be securely affixed via an adjustable camera-mounting bracket 23, to housing 22, adjacent to housing 22 (not illustrated), or reside within housing 22 (not illustrated).

Housing 22 is illustrated as cylindrical but may take any physical shape and be constructed from any durable material. A power supply, such as battery 34 (non-rechargeable or rechargeable), powers tracking device 10, and power button 12 powers tracking device 10 on or off. The location at which the various tracking device components are arranged within housing 22 can vary, and location of components as illustrated in FIG. 7 is simply illustrative configuration and not absolute.

Inertial measurement unit 26 measures the firearm's velocity and orientation of the firearm to which tracking device 10 is affixed based on the user's movement of the firearm. While specifically discussed as an "inertial measurement unit," which is well known in the art, tracking device 10 could employ any device used for motion-detection such as accelerometer, a gyroscope, rotary encoder, displacement sensor, altimeter, angular motion sensor, etc., or any combination thereof without departing from the scope of the present invention.

Radar sensor 24 is employed to calculate the distance of a target from the firearm to which tracking device 10 is affixed. As is well known radar is used for object (target) detection and can determine a target's altitude, range, direction of travel and speed. As illustrated herein radar sensor 24 employs a horn antenna to direct the radio waves towards the target to which the firearm is aimed. Radar sensor 24 is a monostatic radar sensor, transmitting and receiving radio signals with the same antenna. However, any style of antenna could be employed without departing from scope of the present invention.

Tracking device 10 can communicate with other computing devices through wired communication (not shown) via electrical connector 16. However, wireless transceiver 31 allows tracking device 10 to communicate with remote computing devices via wireless communication.

Figure 9:
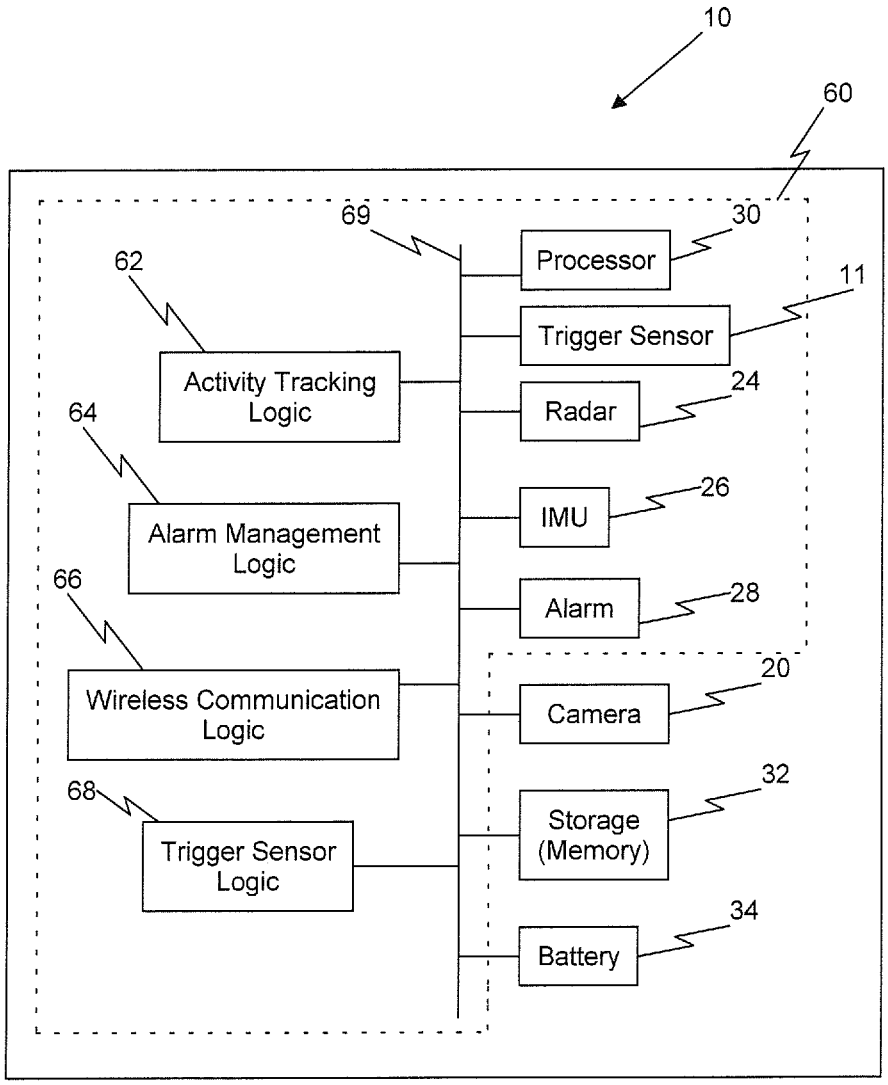
FIG. 9 illustrates an example tracking device including components utilized for target tracking activity and motion of the device, in accordance with one embodiment of the present invention.

As shown in FIG. 9, tracking device 10 includes logic system 60 (dashed line on FIG. 9). Logic 60 may include activity tracking logic 62, alarm management logic 64, wireless communication logic 66, and trigger sensor logic 68, as well as processor 30, radar sensor 24, inertial measurement unit (IMU) 26, and alarm 28. Additionally, storage (memory) 32 and a battery 34 are integrated within activity tracking device 10, as is camera 20. Activity tracking logic 62 is configured to process motion data produced by the IMU 26 and process distance data produced by radar sensor 24 and quantify the data.

Alarm management logic 64 activates alarm 28 under certain conditions and operates in conjunction with trigger sensor logic 68 and activity tracking logic 62. Trigger sensor logic 68 is configured to detect trigger movement. Orifices 14 (FIG. 6) provide the means for alarm 28 to alert the user, serving as way for sound waves to escape housing 22 in the case of an audible alarm, or as mounting orifices for light emitting diodes, should a non-audible alarm be employed. Additionally, alarm 28 may employ haptic feedback technology, producing a vibrating alarm to alert the user of a successful hit or miss. A motor integrated into the tracking device 10 and managed by alarm management logic 64 could produce the vibration.

Wireless communication logic 66 is configured for wireless communication with another computing device via a wireless signal. The signal can be in the form of a Wi-Fi signal, a Bluetooth signal, or any form of wireless tethering or near field communication. The wireless communication logic 66 interfaces with process 30, storage 32, and battery 34 for transferring motion data produced by the IMU 26 and process distance data produced by radar sensor 24, stored in storage 32 to a remote computing device.

Processor 30 functions in conjunction with logic components 62, 64, 66, and 68, providing the functionality of any one or all of the logic components (62, 64, 66, and 68). Bus 69 allows communication between logic components (62, 64, 66, and 68) and processor 30. Storage 32 also communicates via 69 with logic components (62, 64, 66, and 68) to provide storage of all data received by tracking device 10, including the image data or video data from camera 20. Processor 30 is configured to run specific operations embodied as computer-readable code, and is not necessarily one chip or module, but can be a collection of components, logic, code, and firmware. Processor 30 can be interfaced with (or include) an application specific integrated circuit, various programmable logic devices, and a central processing unit.

Figure 10:
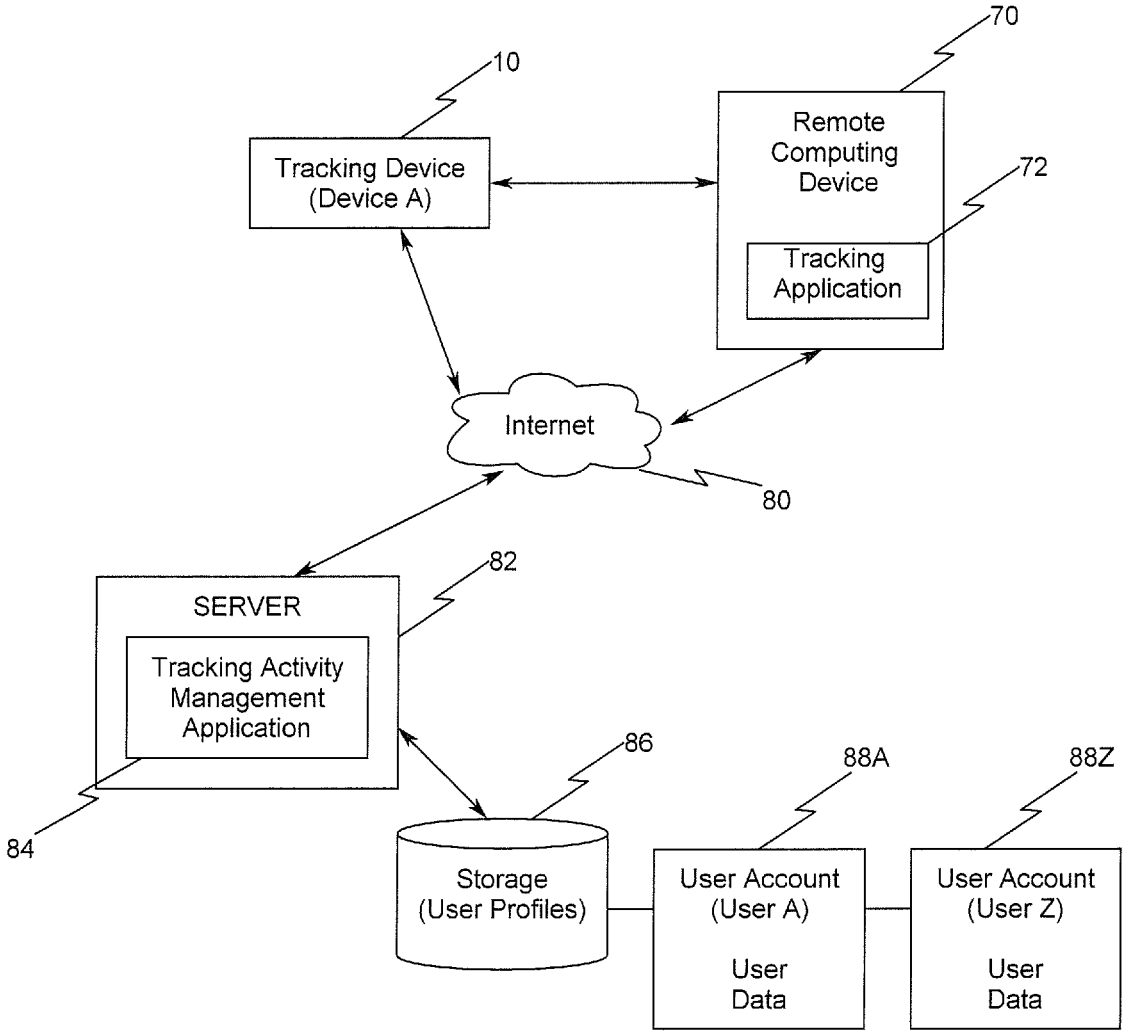
FIG. 10 illustrates an example tracking device in communication with a remote computing device, in accordance with one embodiment of the present invention.

Turning now to FIG. 10, an exemplary environment illustrating tracking device 10 in communication with a remote computing device 70 is shown. Remote computing device can be a any computing device: e.g., laptop, desktop, tablet, smartphone, or an computing device capable of wireless communication with the internet 80 and tracking device 10 (Device A). Remote computing device 70 is capable of wireless communication with the Internet 80 as well as tracking device 10. Installed on remote computing device 70 is tracking application 72, which may be downloaded from server 82. Once application 72 has been installed on remote computing device 70, remote computing device can be configured to communicate with tracking device 10 (Device A).

Server 82 can include a number of applications related to or servicing tracking device 10 and the associated users of tracking device 10 via user accounts. Two exemplary accounts user account (User A) 88A and user account 88Z are shown. Tracking activity management application 84 includes logic for providing access to various user accounts 88A, 88Z as well as various tracking devices 10. Server 82 can include storage 86 for storing the user profile data associated with user accounts. The user data associated with user accounts can include data associated with the height, weight, and sex of the user, the type of firearm tracking device 10 has been secured to, barrel length, gauge of shell, shot size, barrel choke, etc., all of which are modifiable by the user and aid in increasing the accuracy in which tracking device 10 determines the probability of a "hit" as will be discussed in further detail below (See FIG. 11). It should be noted that a single user account could have various tracking devices 10 associated therewith.

Figure 8:
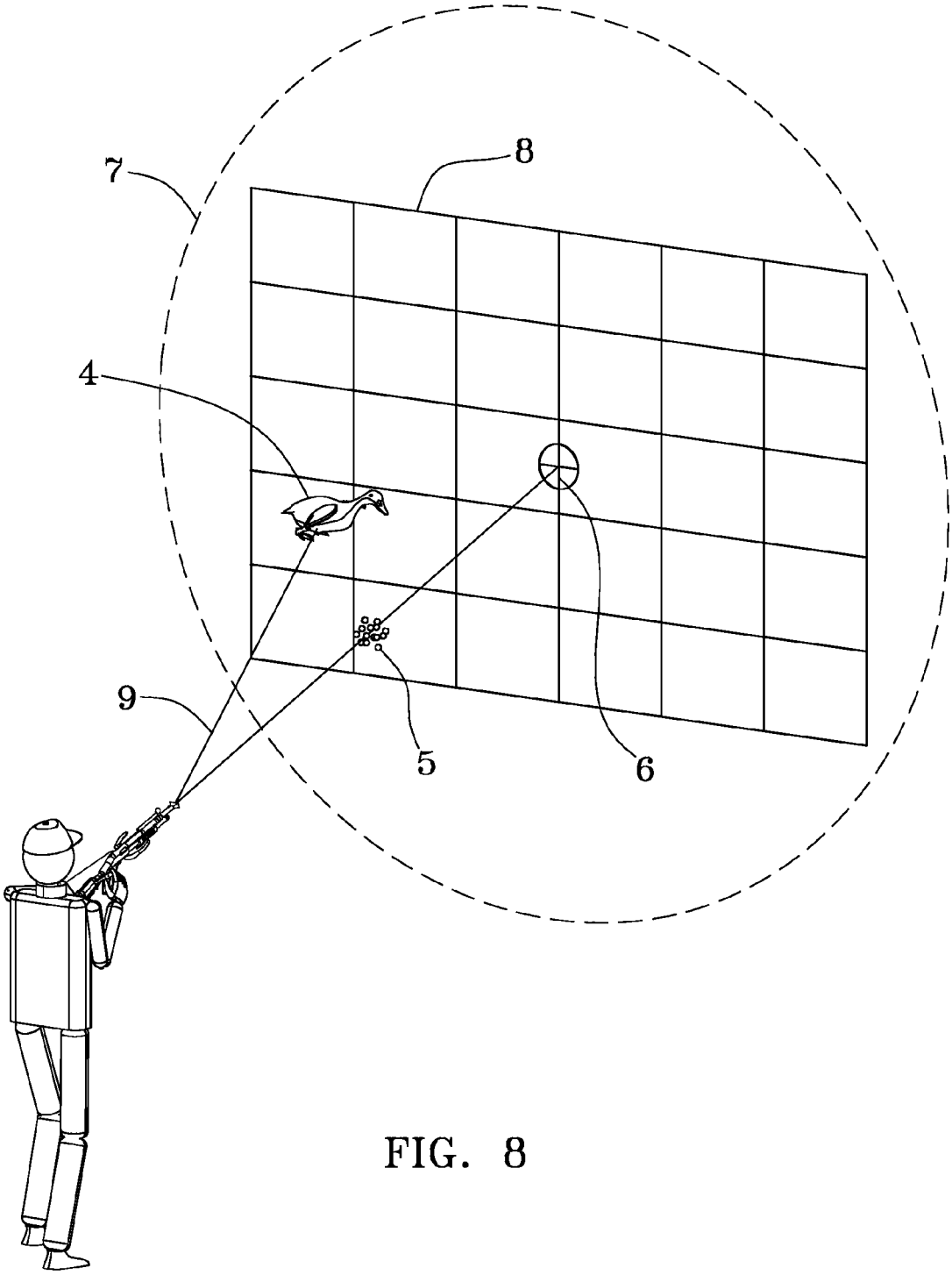
FIG. 8 illustrates an embodiment of the present invention in use.
Figure 11:
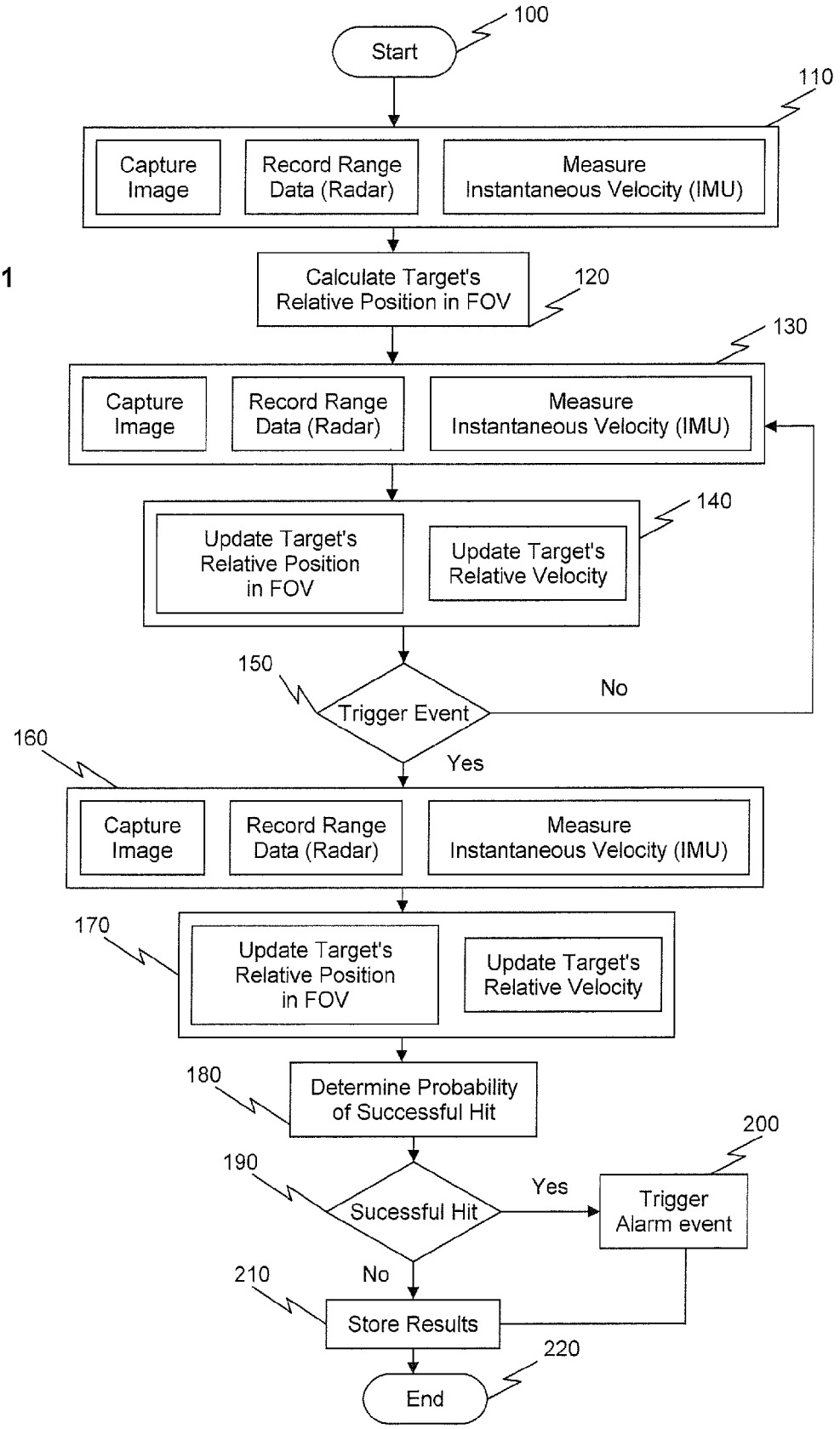
FIG. 11 is a flowchart diagram illustrating the operation of the tracking device in accordance with one embodiment of the present invention.

FIG. 11 is a flowchart illustrating the method operations performed in implementing the functionality of tracking device 10. In one embodiment the method begins in operation when button 12 is pressed by the user, and in another embodiment the tracking device 10 turns on automatically when the firearm to which it is affixed is in motion and a predetermined tilt direction is detected, and/or an object is detected in the field of view "FOV" 7 of radar 24 (FIG. 8), step 100. Once the method of tracking device 10 is initiated, simultaneously the camera 20 records image data, as radar 24 measures the distance 9 to target 4 within radar FOV 7, as IMU 26 measures velocity of firearm and the firearm's orientation to which tracking device 10 is affixed, step 110. Continuing to look at FIG. 8 in conjunction with FIG. 11, the relative location of target 4 is calculated in reference to center location 6 of camera FOV 8, step 120. The data collection, step 110 and calculation of target position, step 120 are repeated at fixed sampling interval Δt and updated in steps 130 and 140. With each subsequent data collection (iteration), the velocity of the target 4 is calculated by comparing the change in location of target 4 in camera FOV 8, change in target pixel coverage (image data captured by camera 20), and change in range 9 to target 4 within measurement interval Δt. The relative velocity of the target 4 is then calculated as the difference between the current IMU 26 velocity measurement and target's 4 velocity calculation. Additionally, target's 4 relative velocity is calculated using Doppler radar processing methods using data captured by radar sensor 24, and these two results are combined to provide a relative velocity estimate of the target 4, at step 140. Measurements and calculations continue at fixed sampling interval Δt until trigger sensor 11 is activated (trigger is pulled), step 150. If a trigger event has occurred, final relative target velocity, distance, and relative target location are measured and/or calculated, at steps 160, 170 respectively. Projectile motion of shotgun shot is calculated using information on shotgun load type, shot velocity as a function of distance and load type, and shot dispersion pattern 5 as a function of distance and effects of gravity. Probability of intersection of shot pattern 5 with target 4 is calculated and probability of successful take down of target is calculated based on probability of shot intersection with target 4, shot pattern 5 dispersion size at intersection range and shot velocity at intersection point, step 180. If a successful hit, user is informed of success of hit by visual, audible means, or through haptic feedback or by any combination of the three, at alarm event, step 200. All data and results can be stored locally (step 210) on removable media or uploaded via Wi-Fi, Bluetooth or other wireless means to smartphone. Additionally, results with performance statistics can be displayed on a local screen or on a smartphone using an associated smartphone application or uploaded to the cloud or emailed, which can then be shared with social networking applications. Additionally, using the images obtained by the camera, combined with the size information obtained from the range information, the camera FOV, and the angle subtended by the target, and potentially GPS location, automatic bird identification will be possible.

Tracking device 10 and its method of operation described herein may calculate various metrics derived from the data captured such has hit/miss ratio, the distance by which a user is leading or lagging a sighted target, allowing the user to see why he or she is successful or unsuccessful. The hunter can use this data and metrics to adjust his/her gun handling accordingly.

Although specific embodiments have been illustrated and described herein, it will be appreciated by those of ordinary skill in the art that a wide variety of alternate and/or equivalent implementations calculated to achieve the same purposes may be substituted for the specific embodiments shown and described without departing from the scope of the present invention. Therefore, it is intended that this invention be limited only by the claims and the equivalents thereof.

We claim:

1. A hunting device configured for capturing shotgun movement of a user and movement of a sighted target, comprising:

a camera for capturing data of said sighted target;

an inertial movement unit for capturing target tracking movement data of said shotgun;

a radar sensor adapted to determine and capture distance data of said sighted target;

a trigger sensor for detecting shotgun trigger activation;

a processor being interfaced with said camera, said inertial movement unit, said radar sensor, and said trigger sensor;

said processor configured to process and interpret said image data, said target tracking movement data, said distance data, and said trigger activation;

memory for storing said captured image data, said target tracking movement data, said distance data, and said trigger activation;

a battery for powering said device;

an alarm adapted to activate under predefined conditions; and a wireless transceiver adapted for wireless communication with a remote computing device;

wherein said inertial movement unit, said radar sensor, said processor, said memory, said battery, said alarm, and said wireless transceiver are disposed in a housing; and wherein said remote computing device comprises a user interface adapted to receive and store user data including barrel length, barrel choke, and gauge of shell;

wherein said processor further interprets said user data.

* * * * *